US005584668A

United States Patent [19]

Volkmann

[11] Patent Number: 5,584,668

[45] Date of Patent: Dec. 17, 1996

[54] MULTISTAGE EJECTOR PUMP FOR RADIAL FLOW

[76] Inventor: Thilo Volkmann, Zum Vulting 12, D-59514 Welver, Germany

[21] Appl. No.: 379,514

[22] PCT Filed: Aug. 5, 1993

[86] PCT No.: PCT/EP93/02085

§ 371 Date: Feb. 1, 1995

§ 102(e) Date: Feb. 1, 1995

[87] PCT Pub. No.: WO94/03733

PCT Pub. Date: Feb. 17, 1994

[30] Foreign Application Priority Data

Aug. 6, 1992 [DE] Germany ..... 9210496 U

[51] Int. Cl.[6] ..... F04F 5/00

[52] U.S. Cl. ..... 417/174; 417/161; 417/182; 417/151

[58] Field of Search ..... 417/161, 174, 417/178, 182, 190, 151, 197

[56] References Cited

U.S. PATENT DOCUMENTS

| | | | |
|---|---|---|---|
| 3,352,348 | 11/1967 | Daviau | 417/174 |
| 4,048,798 | 9/1977 | Larkins, Jr. | 417/174 |
| 4,938,665 | 7/1990 | Volkmann | 417/174 |

FOREIGN PATENT DOCUMENTS

| | | | |
|---|---|---|---|
| 41055 | 12/1981 | European Pat. Off. | 417/174 |
| 639208 | 6/1928 | France | 417/161 |
| 639397 | 6/1928 | France | 417/161 |
| 2577254 | 8/1986 | France . | |
| 3420652 | 7/1991 | Germany . | |
| 4900 | 1/1986 | Japan | 417/174 |
| 962 | 1/1916 | Netherlands | 417/161 |
| 308231 | 8/1971 | U.S.S.R. | 417/182 |

OTHER PUBLICATIONS

International Search Report, dated Nov. 16, 1993

*Primary Examiner*—Timothy S. Thorpe
*Assistant Examiner*—Ted Kim
*Attorney, Agent, or Firm*—Vickers, Daniels & Young

[57] ABSTRACT

A multi-stage ejector pump for suction or for moving materials with the help of a working fluid within one housing is provided. The pump is designed for radial flow and includes at least one inlet for the working fluid, at least one inlet for the materials and at least one flow channel for the mixture of working fluid and materials. The pump includes at least one suction chamber per pump stage, each suction chamber being connected to a common antechamber with the intake of the materials at one end and the flow channel on the other. The flow channel is circular in shape and constructed for radially outward directed flow. The wall elements of the flow channel are comprised of ejector rings located concentrically to each other, adjacent ejector rings forming a passage for the materials between each suction chamber and the flow channel.

11 Claims, 4 Drawing Sheets

MULTISTAGE EJECTOR PUMP FOR RADIAL FLOW

Figure 1:
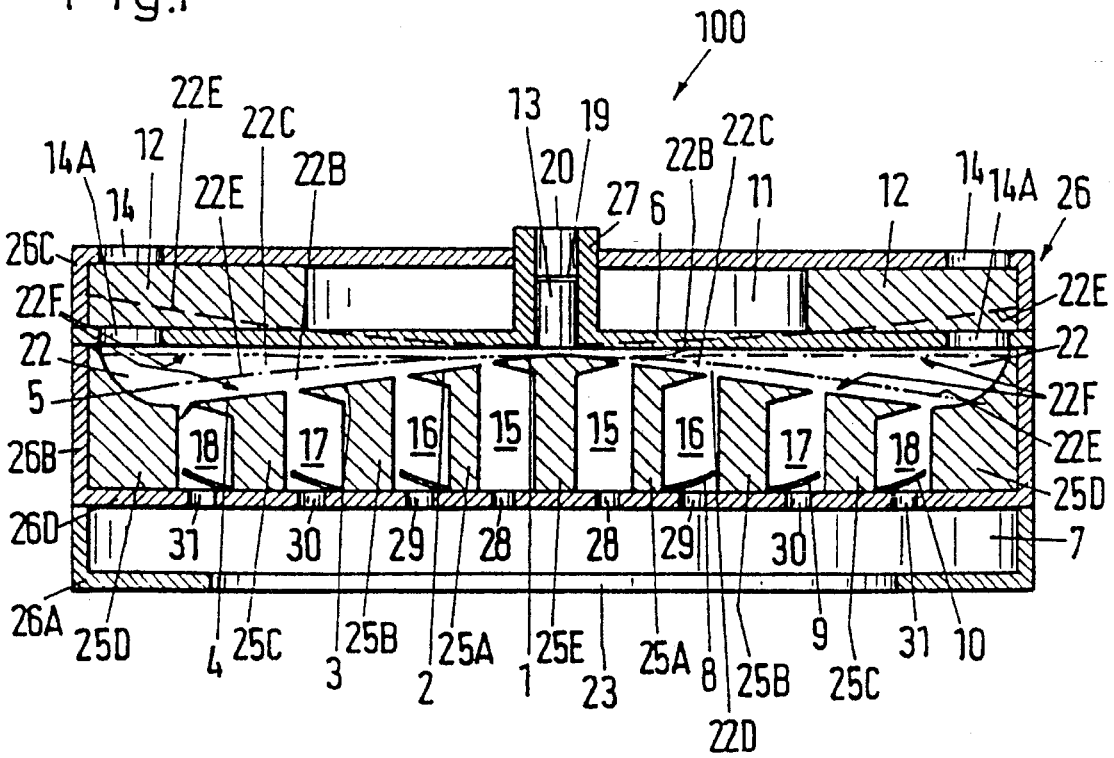

This application is a 371 of PCT/EP93/02085 filed Aug. 5, 1993.

BACKGROUND AND SUMMARY OF THE INVENTION

Ejector pumps of this kind have been known for some time (FR-A1-25 77 284) and are being used for both, to generate vacuum and to move materials, capable of flowing. With a known sequential multistage design, a high degree of efficiency can be obtained, especially with high vacuum. This one has the advantage, that the flow energy of the working fluid, which can either be in gaseous or liquid form, is being used until the flow velocity has dropped below a level, which no longer can be used with any constructive effort.

Multi stage ejector pumps basically have the problem, in that the package size increases super-proportionally with the number of stages. This fact among others is due to the fact, that the cross sectional area of the flow channel has to increase from one stage to the next, and this will tend to expand the height of such an ejector assembly with several stages, without actually being able to use all of the entire volume. One example of this is an ejector pump having a square shaped housing.

The goal of this invention is, to improve ejector pumps of the type previously mentioned, so that in spite of the necessary enlargements of the flow channel, package size and especially package height can be kept small.

This task will be solved with an ejector pump having multiple pump stages for suction or for moving materials or material mixtures which are capable of flowing with the help of a working fluid within one housing. This is further accomplished with the ejector pump having a flow channel being circular in shape and constructed for a radially outward directed flow.

The ejector pump, according to this invention, in spite of extreme compactness and efficiency, can be easily manufactured, especially from (mass) turned or assembled parts. It can be manufactured from almost any material, as for example from metal, plastic, glass, ceramic, etc.

The principle of using a circular shaped flow channel for an ejector pump is basically already know from DE-A1-34 20 652—but solely for single stage ejector pumps. With this single stage ejector pump, it was basically a matter of high precision in order to realize very specific angular relationships and lengths in the area of the nozzle, the mixing zone and the diffuser. This could be accomplished by fashioning all essential parts such as the nozzle, mixing zone and diffuser on one or both faces as solid blocks, which could be accomplished in single phase, using a CNC controlled lathe. It resulted in high precision and good repeatability in the manufacturing of a large number of pumps. One significant disadvantage of this well known ejector pump is the fact that it consist of only a single stage. Another significant disadvantage is the fact, that the suction chamber, through which the flow medium or flow medium mixture is advanced towards the circular shaped, radially outward directed flow channel, is fashioned as a groove increasing its cross-section towards the flow channel, whereby the charging of this circular shaped groove with the flow medium or flow medium mixture take place through several, connecting openings spread out over the circumference, all of which end in a common antechamber. This type of construction, and the corresponding manufacturing process of these well known ejector pumps, results in undesirable flow relationships, for the flow medium or flow medium mixture as it is entering the circular shaped flow channel. An additional disadvantage of this well known ejector pump relates to the fixation on the very specific surface contour to be used for the flow channel. This allows an optimal pump efficiency only when the viscosity of the working fluid and/or of the flow medium or flow medium mixture lies within narrowly defined parameters. Different pumps each time are required to solve differing flow requirements, especially when moving a flow medium or flow medium mixture. Further problems are encountered if the viscosity of the same deviates from the ideal conditions for which this ejector pump had been designed, or when employing other work fluids. At least the pumping block has to be changed on the face of which the nozzle, the mixing zone and the diffuser has been worn in.

In contrast to this ringlike constructed ejector pump known from DE-A1-34 20 652, the ejector pump of this invention, has a series of significant advantages. One advantage is the fact, that it is very easily possible to apply the circular geometry of the flow channel and all of its related advantages to multi stage ejector pumps. Another advantage is the fact, that the flow relationships, compared to the single stage ejector pump known from DE-A1-34 20 652, are significantly balanced out as the flow medium or flow medium mixture enters the flow channel. Another advantage is, that in spite of being multi staged, the ejector pump, according to this invention, is easy to manufacture, since it can be build from simple turned or assembled mass produced parts, whereby the individual ejector rings can be reworked or exchanged, if necessary, for optimizing the ejector pump in each case for the required purpose.

The basic philosophy, on which the present invention is based, is, that in the case of a multi stage ejector pump, the circular shaped flow channel for radially directed flow from the inside out, can also used be put to practical use in such a way, that the wall areas of the flow channel in the mixing zone and the diffuser of one of the pump stages are axially adjustable in relation to the other walls of the flow channel. In this way, the flow relationships in the flow channel can be adopted to particular flow requirements, even with such multi stage ejector pumps, which do not have a narrow passage between the suction chamber and the flow channel, as with DE-A1-34 20 652.

The working fluid, as far as the invention is concerned, can be in liquid or gaseous form, as well as the flow medium or flow medium mixture which is capable of flowing.

"Ejector rings," as far as the invention is concerned, are preferably components, independent from each other, which are placed into the pump housing, which, as will be shown later, can be accomplished in various ways. As long as the cross sectional reduction at the passage for the flow medium or flow medium mixture, capable of flowing, between the particular suction chamber and the flow channel is not exceedingly great, it may be possible to machine the ejector rings with the wall areas, which make up the suction chamber, as a single piece.

The basic outline of the ejector rings (viewed in axial direction) should preferably be circular in shape. The cross section of the ejector rings (also viewed in axial direction) can be varied to a large degree, based on the requirements of the application: for instance, it can be cylindrical or preferably, conical in shape (see design examples according to FIG. 1 to 4). The side walls, forming a part of the flow channel of the ejector ring, can be fashioned with many contours, especially viewed radially towards the outside (see design examples according to FIG. 5 to 9). The angle of inclination of the mixing zone especially, referenced to axial direction of the flow channel, can be varied. The ejector rings can also have a wavy surface, which effectively enlarges the suction passage, and whereby the flow relationships in the flow channel are controlled by local cross sectional changes (see design examples according to FIG. 5 and 9). It is further advantageous to place flow directing profiles sideways, as seen in axial direction above the ejector rings, (see design examples according to FIG. 9), which makes it possible to reduce turbulence to a relatively low level, which may result by mixing of the flow medium or flow medium mixture with the working fluid. The guiding profiles make it further possible to reduce the residual energy of the working fluid, which in turn increases the efficiency factor of the pump. Such flow channel designs have not been made public.

The mounting of the ejector rings can be basically done on the faces of the divider wall, separating the two suction chambers, but it is especially of advantage if they are already attached to the divider walls before assembly, and preferably are in one piece, so that the subassembly, consisting of ejector ring and divider wall, can be installed into the pump.

While the position of the individual ejector rings (as viewed in axial direction) in relation to each other as well as to the remaining parts of the pump can remain unchanged in most cases, one special feature of the invention is, that the axial position of the ejector rings, and consequently the cross sectional shape of the flow channel can be changed. Such a change in position can be accomplished in several different ways, as for example with the use of slides or screw threads, the diameter of which can correspond to the diameter of the corresponding ejector ring. Especially easy to manufacture, to assemble and to adjust afterwards from the outside are such adjustment features, which consist of telescope like nested tubes, on the faces of which (on side of flow channel) are attached radially and axially or conically directed wall elements, which serve as separations from the adjacent suction chambers, and the circular face areas themselves, which serve in part as side walls of the flow channel or carry the corresponding ejector ring.

The components, previously mentioned and claimed, as described in the construction examples, to be used for the invention, are not subject to any special exceptions as to their size, shape, material selection and technical design, in which case the selection criteria, which is customary for the appropriate application, can be employed without limitation.

The following descriptions of the associated drawing, which depicts a multistage ejector pump, according to the invention, contain further details, features and advantages of the object of this invention. The drawings show:

FIG. 1 An axial sectional view of a multistage ejector pump, according to the invention.

Figure 2:
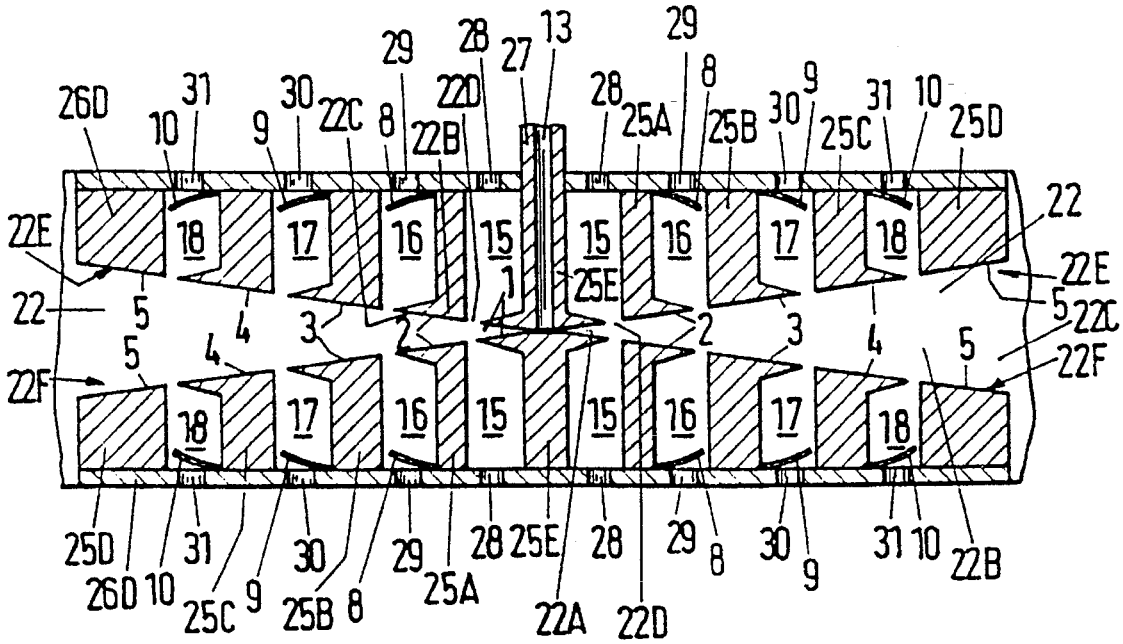

FIG. 2 A second design of an ejector pump, according to the invention, in the same sectional view as FIG. 1—partial.

Figure 3:
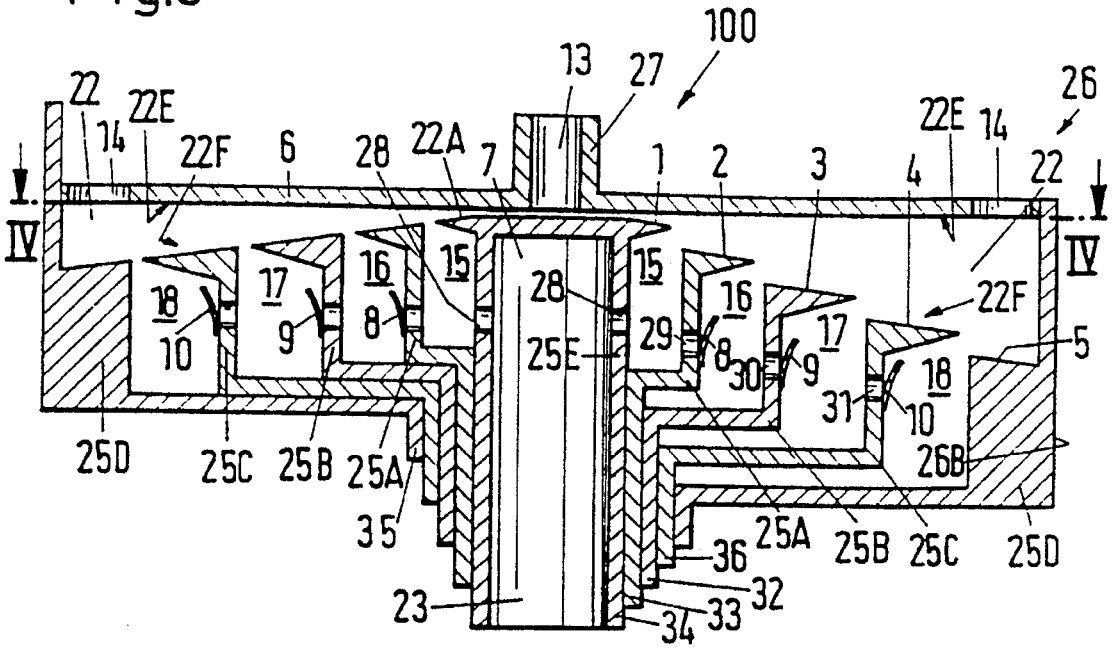
Figure 4:
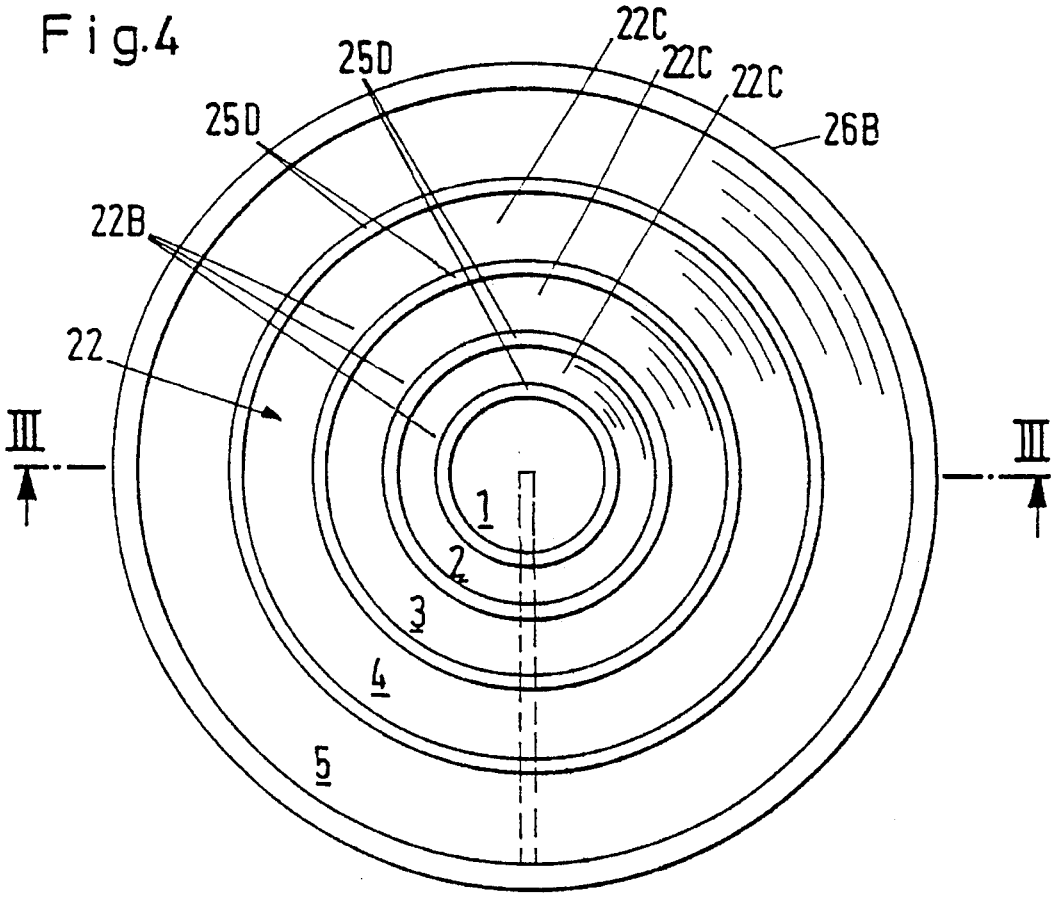

FIG. 3 A third design of an ejector pump, according to the invention, again in an axial sectional view (view along the line III—III according to FIG. 4).

FIG. 4 A top view of the same ejector pump as in FIG. 3 (view along the line IV—IV, according to FIG. 3).

Figure 5:
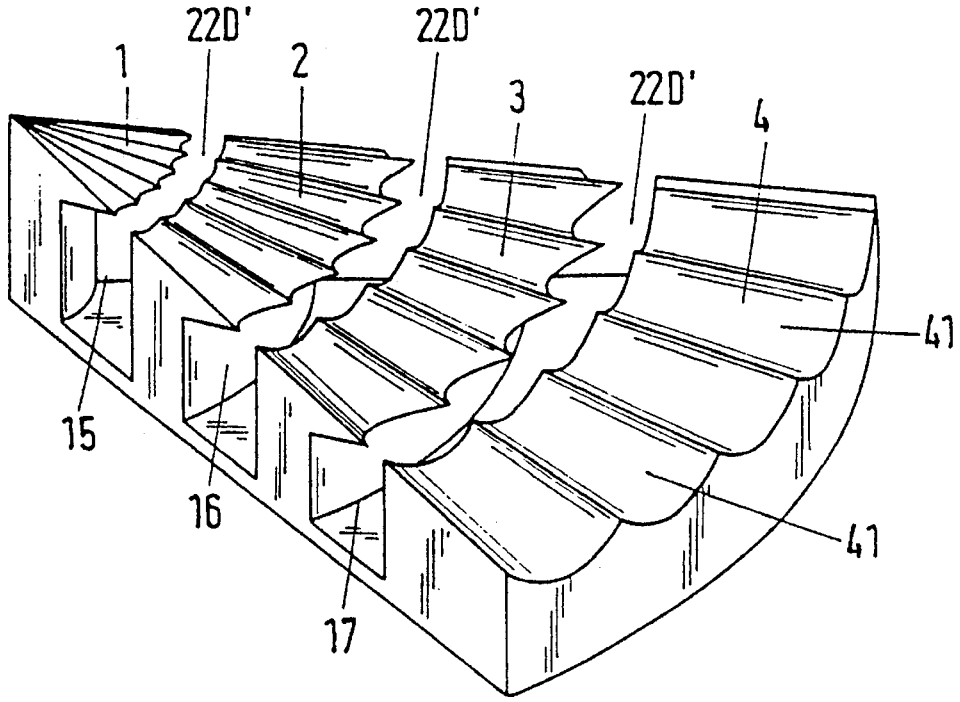

FIG. 5 An alternate design of the ejector rings with wavy surface (perspective view of a wedge shaped section of an arrangement of the ejector rings of an ejector pump, according to the invention).

Figure 6:
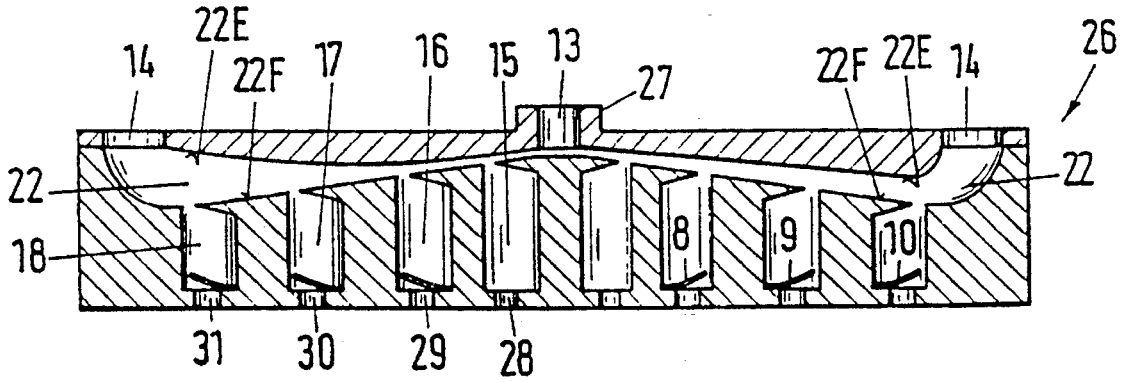

FIG. 6 An alternate shape of the flow channel to the design example, according to FIG. 1 as an axial section (partial).

Figure 7:
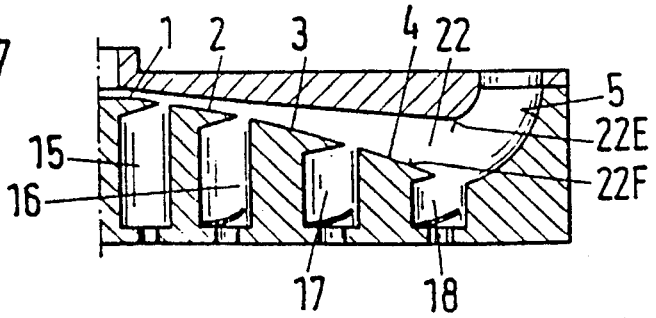

FIG. 7 An other shape flow channel to the design example in a partial axial section of one half of the ejector pump.

Figure 8:
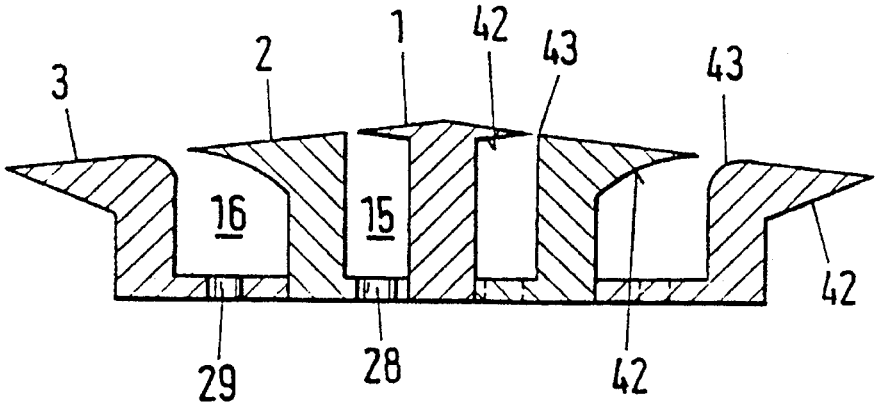

FIG. 8 An example presentation of a possible ejector ring design, using an ejector ring set in an axial, sectional view as well.

Figure 9:
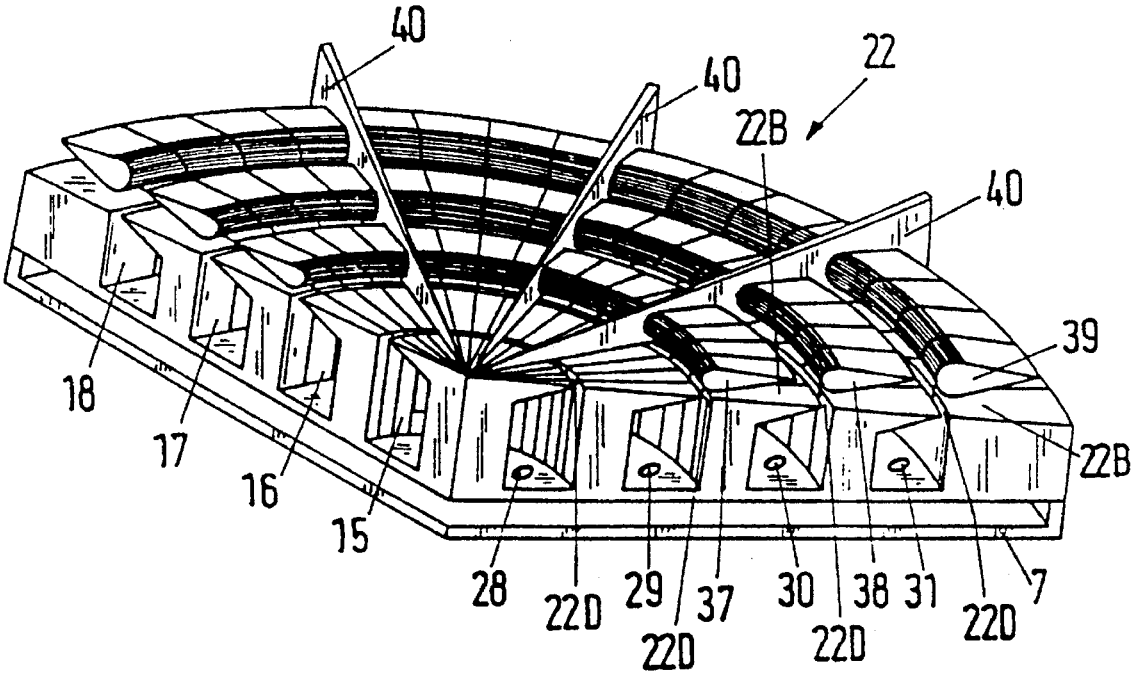

FIG. 9 A perspective view of an ejector pump segment, which in addition has been provided with flow directing profiles.

The 4 stage ejector pump unit marked with 100, shown in the design example shown in FIG. 1, has a circular or cylindrical housing 26, which consists of a bottom part 26A with a central intake 23 for the flow medium or flow medium mixture, a cover 26C with a common outlet 14 for the working fluid and the flow medium or flow medium mixture as well as ejector support 26B between the cover and the bottom.

A separation 6 is inserted at the connection between the cover 26C and the ejector support 26B, the surface of which on the cover side borders against the intake chamber 11. A central sleeve section 27, intended for the separation 6, and projecting towards cover 26C from there and projecting through housing 26, forms an inlet 13 for the working fluid, in which a baffle 19 is inserted to pre-distribute the working fluid across the entire inlet cross section, and which could be preceded by a solid matter trapping filter, to prevent erosion on the area of the intake orifice 22A, yet to be explained. The radially outward wall area of separation 6 has in addition been provided with openings 14A, which could, even directly, serve as an outlet, and which in the direction of flow could be followed by a muffler 12.

On the side of separation 6, pointing away from cover 26C, a circular shaped surface forms one wall element 22E of flow channel 22. Across from wall element 22E, at an axial distance from it, wall element 22F will be provided, which will be fashioned from ejector ring 2 and ejector ring 5, yet to be explained, which are positioned concentrically to each other and at a radial distance from each other and a centrally placed ejector disc 1. The flow channel 22 is closed off radially towards the outside by the inner surface of the cylindrical wall-area of ejector support 26B. In this way, the flow channel 22 obtains a circular shape. Because the working fluid is supplied from the centrally located inlet 13 and because the working fluid and the mixture of working fluid and flow medium together are being drawn off through the radial openings 14A from the flow channel 22, situated on the outside of same, the flow channel is designed for flow from the inside in radial direction towards the outside, just as it has basically been known for a single stage ejector pump, according to DE-A1-34 20 65.

The ejector support 26B consists of the cylindrical and disc shaped wall elements, mentioned before, which serve as separation 26D.

The separation 26D, together with bottom part 26A, defines an antechamber 7 on the side pointing towards the bottom part 26A, in which the preliminary distribution of the flow medium is to take place.

On the side of separation 26D, pointing away from the antechamber 7, the separation carries the ejector rings 2 to 5 as well as the ejector disc 1. The ejector rings are provided with separations 25A, 25B, 25C, and 25D for this purpose (in the design example the ejector rings and separations are one single piece), whereby the separations in the illustrated design examples form cylindrical tubing sections of varying length, the length of which decreases in radial outward direction, such that the effective cross sectional area of the flow channel 22 increases in radial direction toward the outside even in the direction of the axis. With this design of flow channel 22, the mixture consisting of working fluid and flow medium displays, aside from the radial, also an additional axial flow component. This also applies for a design, where the wall element 22E runs parallel with wall element 22F along the dash-dot-dot line. It is also possible to eliminate the axial flow component completely, by running the wall element 22F along the dash-dot line in FIG. 1 and to position wall element 22E parallel to the same. In this case we have in flow channel 22 a purely radial flow. By means of a refinement of wall element 22E, according to the dashed line in FIG. 1, which allows the flow channel 22 to expand towards the outside and upward, the centrifugal force of the working fluid can be taken advantage of, which may possibly permit an increase in the efficiency of the ejector pump.

Additional design possibilities for the flow channel 22 are shown in FIG. 6 and 7. With the flow channel 22 as shown on the left side of FIG. 6, the wall element 22F is directed radially outward and inclined downward so that the flow contains an axial component. The implementation of the convex shaped wall element 22E, strives to make use of the centrifugal force of the working fluid. The flow channel shown on the right side of FIG. 6, in contrast consists of a conical surface, which is directed radially outward and inclined downward, so that any use of centrifugal force of the working fluid is eliminated. It is absolutely possible, with use of different wall elements 22E, to adapt the geometry of the flow channel 22 to different working fluids and/or flow materials.

While the designs, discussed up until now, have a wall element 22F, which is partially inclined but flat, a curved course can also be advantageous, as shown in FIG. 7. The ejector disc 1 and the ejector rings 2–4 in this case have a convex shaped surface. The surface of the ejector rings can also be wavy or similar, as shown in FIG. 5, to form radially outward directed flow channels 41 shaped by the ejector rings 1 to 4, which have a straightening effect on the flow in flow channel 22. It can also be advantageous, as shown in FIG. 9, to shape the underside 42 of the ejector rings 2 to 4 or of ejector disc 1, pointed towards the suction chamber 15 to 18, in a concave manner and/or to round off the edges 43, pointing towards the passages 22D, which will effect the direction of the emerging fluid through the passages, and it can also help to reduce the occurrence of a turbulence in the mixing chamber 22B.

The separations 25A to 25D and socket element 25E, also serving as separation, enclose amongst each other circular shaped suction chambers 15 to 18. The separation 26D has openings 28 to 31, to serve as intake openings for the flow medium form the antechamber 7 to the suction chambers 15 to 18. These openings can be equally spaced along the perimeter and be at least partially provided with flap traps 8 to 12. Such flap traps are known, as far as their function and their arrangement in ejector pumps in concerned (for example FR-A1-2 577 284). Their purpose in multistage ejector pumps is to obtain an improved vacuum, in a way by which those suction chambers, which are only able to produce a relatively low vacuum, are mechanically cut of, when reaching this vacuum, from those stages, which create a greater vacuum. This starts with the last stage and ends as a rule with the first.

In the design example, according to FIG. 3 and 4, the ejector rings and the ejector disk are adjustable in the axial direction. The separations 25A and 25B, which carry the ejector rings, show a circular wall area 25D and 25E opposite from the ejector ring end for this purpose, where each is supported by sleeve 32 and 33 radially on the inside. The ejector disc 1 is also supported by a sleeve (sleeve 34), and the housing 26 has a centrally located sleeve section 35. Sleeve 34 shows an outside thread, which corresponds to the inside thread on sleeve 33. Sleeve 33 also has an outside thread, which again corresponds to the inside thread of sleeve 32, and sleeve 32 also has an outside thread, which corresponds to the inside thread of sleeve section 35. In this way, all sleeves 32, 33, 34, 36 and sleeve section 35, including the ejector disk or rings supported by them are telescope like adjustable by turning them in the axial direction of the pump.

The left side of FIG. 3 shows the relative position of the ejector rings and ejector disc, corresponding to the design examples of FIG. 1 and 2, while the ejector rings shown on the right side of FIG. 3 have been adjusted such, that the cross sectional area of the flow channels 22 is increasing significantly in radial direction towards the outside.

The cross sectional area of the flow channel, and the resulting throughput, of flow medium and energy consumption can be adjusted, depending on the working fluid (gas, liquid or steam jet).

The working fluid in all designs is being admitted via the centrally located inlet 13 unto the centrally located ejector disc, from where it flows in radial direction towards the outside and creates vacuums of varying amounts—depending on the geometry of the individual ejector rings to each other—between the individual ejector rings, which results in suction action at the passages of varying amounts.

According to the invention, it is also possible to use ejector ring segments instead of ejector rings.

Another form of an ejector pump is shown in FIG. 9, in which flow directing profiles 37 to 39 (as viewed in direction of flow) are oriented in the flow channel 22 always at the same level as the passages 22D. The flow directing profiles 37 to 39 exhibit symmetrical, wing shaped cross sections, and are oriented such, that the rounded top sides are pointing in the direction of the center of the ejection pump, (are facing the oncoming flow), and the pointed fins in the direction of flow. The flow directing profiles 37 to 39 are held by the vertical separations 40, which divide the radial ejector pump into circular segments. By employment of such flow directing profiles 37 to 39 or separation 40, which incidentally can be employed individually, the direction of the mixture, consisting of working fluid and flow medium located in flow channel 22 is being changed, whereby it is possible to reduce turbulances—especially in the mixing chamber 22B—on one hand, and to obtain a better flow and a reduction of residual energy of the working fluid on the other.

| | |
|---|---|
| 1 | Ejector disc |
| 2 | Ejector ring |
| 3 | Ejector ring |
| 4 | Ejector ring |
| 5 | Ejector ring |
| 6 | Separation |
| 7 | Antechamber |
| 8 | Flap trap |
| 9 | Flap trap |
| 10 | Flap trap |
| 11 | Intake chamber |
| 12 | Muffler |
| 13 | Inlet |
| 14 | Outlet |
| 14A | Openings |

-continued

| | |
|---|---|
| 15 | Suction chamber |
| 15A | Holes |
| 16 | Suction chamber |
| 17 | Suction chamber |
| 18 | Suction chamber |
| 19 | Baffle |
| 20 | Solid matter filter |
| 22 | Flow channel |
| 22A | Orifice |
| 22B | Mixing chamber |
| 22C | Diffuser |
| 22D | Passage |
| 22E | Wall element |
| 22F | Wall element |
| 23 | Intake |
| 25A | Separation |
| 25B | Separation |
| 25C | Separation |
| 25D | Separation |
| 25E | Separation |
| 26 | Housing |
| 26A | Bottom |
| 26B | Ejector support |
| 26C | Cover |
| 26D | Separation |
| 27 | Sleeve section |
| 28 | Openings |
| 29 | Openings |
| 30 | Openings |
| 31 | Openings |
| 32 | Sleeve |
| 33 | Sleeve |
| 34 | Sleeve |
| 35 | Sleeve section |
| 36 | Sleeve |
| 37 | Flow directing profile |
| 38 | Flow directing profile |
| 39 | Flow directing profile |
| 40 | Separation |
| 41 | Flow trough |
| 42 | Underside |

What is claimed is:

1. A multi-stage ejector pump having multiple pump stages for suction or for moving materials or material mixtures which are capable of flowing, with the help of a working fluid within one housing, said pump including at least one inlet for the working fluid, at least one inlet for the materials, at least one flow channel for a mixture and common flow of said working fluid and said materials, at least one orifice into the flow channel and several mixing zones in the flow channel, at least one suction chamber per pump stage, each said suction chamber being connected to a common ante-chamber for the intake of the materials at one end and the flow channel on the other end, and at least one common outlet from the flow channel for said mixture, the improvement comprising:

said flow channel being constructed for a radially outward directed flow, whereby the wall elements of the flow channel comprise two adjacent and opposing wall elements having a distance therebetween, and at least one of the two wall elements are comprised of ejector rings located concentrically to each other, adjacent ejector rings forming said suction chambers, each said suction chamber having a passage adjacent the flow channel for allowing flow of said materials between said suction chamber and said flow channel.

2. Multi-stage ejector pump having multiple pump stages for suction or for moving materials or material mixtures which are capable of flowing, with the help of a working fluid within one housing, said pump including at least one inlet for the working fluid, at least one inlet for the materials, at least one flow channel for a mixture and common flow of the working fluid and the materials, at least one intake orifice into the flow channel and several mixing zones in the flow channel, at least one suction chamber per pump stage, each said suction chamber being connected to a common ante-chamber for the intake of the materials at one end and the flow channel on the other end, and at least one common outlet from the flow channel for the working fluid and materials, the improvement comprising:

said flow channel being circular in shape and constructed for a radially outward directed flow, the wall elements of the flow channel comprised of two adjacent and opposing wall elements disc shaped or circular in shape and having a distance therebetween, and at least one of the two wall elements is comprised of ejector rings located concentrically to each other, adjacent ejector rings forming a passage for the flow of materials between each said suction chamber and the flow channel.

3. Multi-stage ejector pump, according to claim 2, including suction chambers, which are circular in shape.

4. Multi-stage ejector pump, according to claim 2 wherein said ejector rings are provided with cylindrical separations oriented at an angle to said ejector rings, for separating adjacent suction chambers from each other.

5. Multi-stage ejector pump, according to claim 1, wherein said housing has an axial direction corresponding to the working fluid inlet direction, and said ejector rings further being adjustable in said axial direction and connected to the housing.

6. Multi-stage ejector pump, according to claim 5, further including sleeves, located inside each other in telescoping fashion, for axial adjustment of the ejector rings (2 to 5).

7. Multi-stage ejector pump, according to claim 3, wherein said ejector rings are provided with cylindrical separations oriented at an angle to said ejector rings, for separating adjacent suction chambers from each other.

8. Multi-stage ejector pump, according to claim 2, wherein said housing has an axial direction corresponding to the working fluid inlet direction, and said ejector rings being adjustable in said axial direction and connected to the housing.

9. Multi-stage ejector pump, according to claim 8, further including sleeves (32 to 35), located inside each other in telescoping fashion, for axial adjustment of the ejector rings (2 to 5).

10. Multi-stage ejector pump, according to claim 3, wherein said housing has an axial direction corresponding to the working fluid inlet direction, and said ejector rings being adjustable in said axial direction and connected to the housing.

11. Multi-stage ejector pump, according to claim 10, further including sleeves (32 to 35), located inside each other in telescoping fashion, for axial adjustment of the ejector rings (2 to 5).

* * * * *